United States Patent [19]

Godlewski

[11] 4,375,143

[45] Mar. 1, 1983

[54] MORTAR STOP FOR HOLLOW BLOCK FOUNDATION WALLS WITH ATTACHED LOCATOR TAB

[76] Inventor: Joseph F. Godlewski, 13208 Second Ave., Cresaptown, Md. 21502

[21] Appl. No.: 197,559

[22] Filed: Oct. 16, 1980

[51] Int. Cl.[3] ..... E04B 2/14

[52] U.S. Cl. ..... 52/98; 52/105; 52/421

[58] Field of Search ..... 52/421, 98–100, 52/105, 664, 442, 562, 542, 565; 33/407, 408, 409

[56] References Cited

U.S. PATENT DOCUMENTS

| | | | |
|---|---|---|---|
| 692,544 | 2/1902 | Record | 52/421 |
| 933,163 | 9/1909 | Davis | 52/421 |
| 1,250,622 | 12/1917 | Munro | 52/98 |
| 1,297,151 | 3/1919 | Griffin | 52/439 |
| 2,252,155 | 8/1941 | Baldwin | 52/562 |
| 3,780,773 | 12/1973 | Haugen | 52/421 |

FOREIGN PATENT DOCUMENTS

| | | | |
|---|---|---|---|
| 2712642 | 9/1978 | Fed. Rep. of Germany | 52/421 |
| 192279 | 2/1923 | United Kingdom | 52/441 |

*Primary Examiner*—John E. Murtagh

*Attorney, Agent, or Firm*—Brady, O'Boyle & Gates

[57] ABSTRACT

A flat screen mesh element formed of metal or plastics material covers one or more core openings in a block of the next to topmost course in a foundation wall. When the topmost course of blocks is in place, mortar used to embed a foundation cap plate anchor bolt is placed in the core opening of a top course block which is in alignment with a locator tab carried by one end of the screen mesh element and extending beyond a surface of the foundation wall. The screen mesh element prevents the mortar from entering a core opening or openings of blocks below the topmost course. A large savings of mortar is achieved and the anchor bolts are installed at a uniform level on the foundation wall.

5 Claims, 4 Drawing Figures

FIG. 1
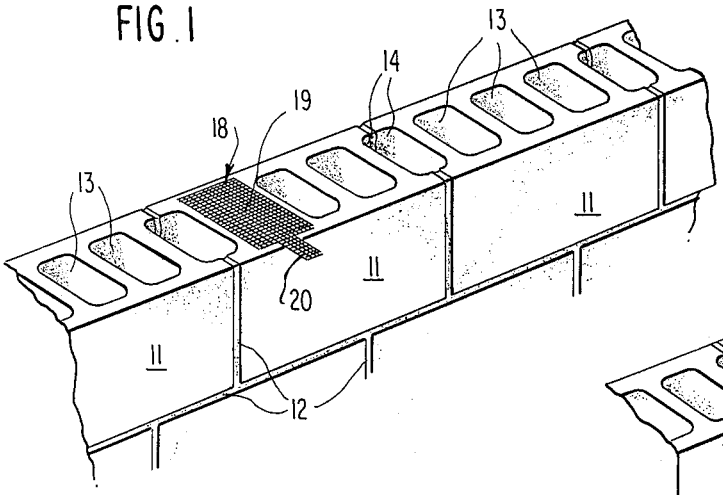
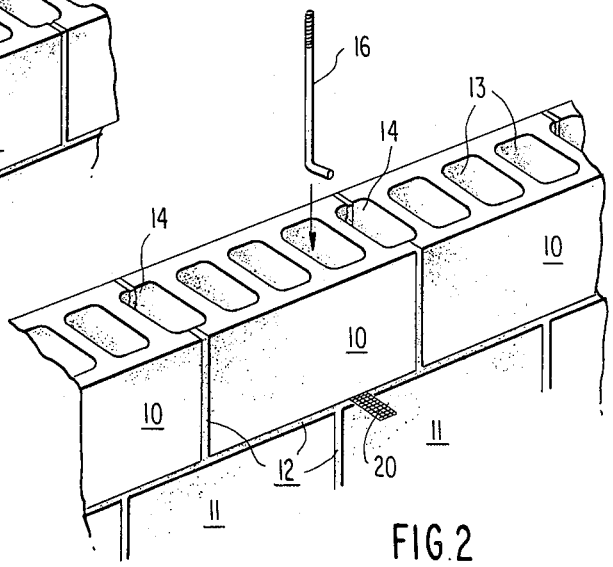
FIG. 2
FIG. 3
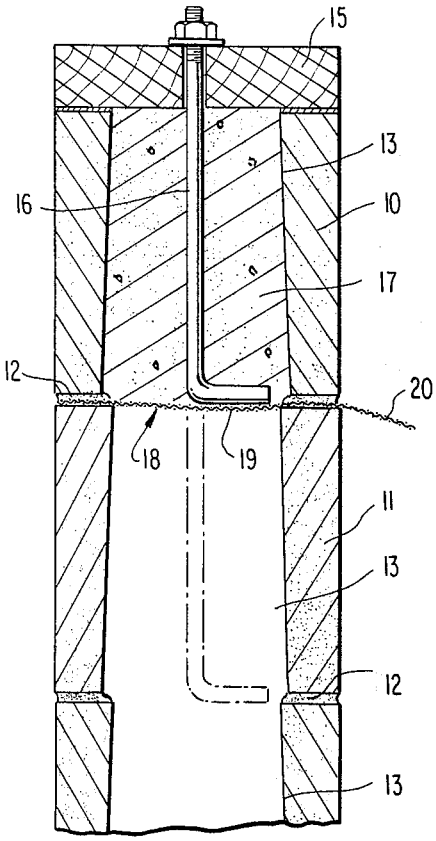
FIG. 4
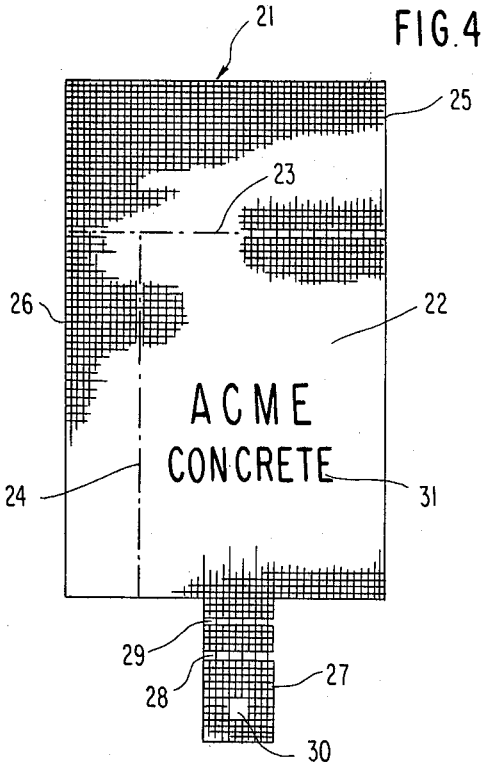

MORTAR STOP FOR HOLLOW BLOCK FOUNDATION WALLS WITH ATTACHED LOCATOR TAB

BACKGROUND OF THE INVENTION

In the present-day construction of building foundation walls, it is becoming a practice to employ hollow cement or cinder building blocks in all courses of the wall including the top course for the sake of economy and standardization. Heretofore, and to some extent at the present time, solid blocks were required in the top course of the foundation wall for added strength, to block termites and for other reasons.

Where hollow building blocks are used for the top course immediately below the wooden cap plate on which the framing is built, it has become a rather standard practice to fill up the vertical core openings of the blocks in all but the topmost course which are aligned with the cap plate anchor bolts with various trash from the job site, including paper bags, scraps of lumber and other material. This trash then forms a support bed for mortar placed in aligned core openings of the top course of blocks at regular intervals along the foundation wall to embed the anchor bolts which securely tie the wooden cap plate to the wall.

There are several disadvantages with the use of trash as a filler for the block passages. One disadvantage is that much of the trash is cellulosic in nature and thus invites termites. Furthermore, the trash is never solidly packed to an even level in the block passages and can either allow much mortar to fall into passages in lower courses of blocks, causing an economic loss, or to obstruct partially the placement of sufficient mortar in the selected passages of top course blocks to embed the cap plate anchor bolts.

The present invention completely overcomes these and other drawbacks of the prior art practices while at the same time providing a convenient and reliable visual indicator to enable the mason to select the proper openings of the top course building blocks for the placement of the anchoring mortar in the minimum time. The invention therefore constitutes a labor saving device, and the time saved is considerable in a large wall.

The properly placed mortar stop or screen functions to insolate the anchor bolt mortar from the block passages below the topmost course and thus prevents the loss of mortar into these passages. It assures a proper and complete filling of the selected passages in the top course only to firmly embed the anchor bolts, to strengthen the top course of blocks, and, most importantly, to assure a uniform level for the anchor bolts throughout the entire wall undergoing construction.

Other features and advantages of the invention will be explained in the course of the following detailed description.

BRIEF DESCRIPTION OF THE DRAWINGS

FIG. 1 is a perspective view of a mortar stop for foundation walls according to the invention showing the same in place on a block of the next to topmost course in a foundation wall.

FIG. 2 is a view similar to FIG. 1 showing a projecting locator tab of the mortar stop and showing the top course of blocks in place and a cap plate anchor bolt positioned for placement in the wall.

FIG. 3 is an enlarged fragmentary vertical section taken through a foundation wall equipped with mortar stops in accordance with the invention.

FIG. 4 is a plan view of a mortar stop adapted for use with different sizes of building blocks and having tear-off components.

DETAILED DESCRIPTION

Referring to the drawings in detail wherein like numerals designate like parts, a building foundation wall as shown in the drawings includes a top course formed of hollow cement or cinder building blocks 10 and a next lowermost course consisting of similar blocks 11 laid up in accordance with usual masonry practice and having the customary mortar joints 12 throughout the wall. Depending upon the height of the foundation wall, any required number of block courses below the course of blocks 11 may be included. Each block of the wall illustrated is formed with vertical core openings 13 and mating end recesses 14 which produce similar openings at the ends of adjacent blocks in the several courses. The openings 13 can fall in alignment or communication throughout the wall as depicted in FIG. 3.

The foundation wall is provided with a wooden cap plate 15 resting on the topmost course of blocks 10 and the cap plate is secured by a series of anchor bolts 16 embedded in masses of mortar 17 at regular intervals along the wall, such as every four feet. The described construction is that of a conventional foundation wall in which the mortar stop 18 forming the subject matter of the invention is employed in a unique manner.

As shown in FIGS. 1 through 3, the mortar stop 18 which can be formed of wire mesh or plastics mesh with a mesh size of approximately $\frac{1}{8}$ inch includes a rectangular flat body portion 19 with a comparatively small indicator or locator tab 20 attached integrally and centrally to one end of the body portion 19 and projecting therefrom. The body portion 19 is sized to cover at least one of the block openings 13 of the next to topmost course blocks 11, FIG. 1, with the locator tab 20 extending beyond the interior vertical face of the foundation wall, the body portion 19 being concealed in a mortar joint of the completed wall.

With the mortar stops 18 so placed at regular intervals, the blocks 10 of the topmost course are laid up as shown in FIGS. 2 and 3. The projecting tabs 20 will instantly indicate which of the openings 13 and blocks 10 are to be filled with the mortar 17, thus reducing the labor time for installing the cap plate anchor bolts 16 which are inserted downwardly into the wet mortar 17 to the level of the stop 18 which not only supports the mortar 17 but supports the inserted bolts 16 at a uniform elevation throughout the wall. Thus, the use of the mortar stops 18 greatly simplifies the entire operation of installing the cap plate 15 and anchor bolts. It also prevents mortar from falling into and filling the block passages 13 of courses below the top course and thus saves mortar which is quite expensive.

Following completion of the wall with mortar stops 18 installed, the locator tabs 20 can be bent upwardly or downwardly upon the inner face of a wall and left in place as where firring is to be installed or can be chopped off by a mason's trowel flush with the wall.

FIG. 4 shows a variant of the invention in which the rectangular body portion 21 of the mortar stop includes a first area 22 sized for use on six inch blocks, this dimension referring to block width or thickness, the length and height dimension normally remaining the same for all sizes. The area 22 is bounded along two edges by weakened lines 23 and 24 along which the rectangular portions 25 and 26 can be torn off to adapt the stop to six inch blocks. When eight inch blocks are employed, the areas 25 and 26 remain in place. In some cases, the mortar stop may have only the tear line 23 without the tear line 24, it being immaterial whether the stop covers only one passage 13 or all or part of a second passage.

Similarly, the locator tab 27 of the stop in FIG. 4 may have two weakened transverse separation lines 28 and 29 to facilitate shortening the locator tab 27 in accordance with wall thickness and to compensate for variations in the placement of the stops 18 which is not always consistent and precise. The tab 27 may be parted along either line 28 or 29 or may remain intact, as needs dictate. Each tab 27 may have an aperture 30 formed therethrough to facilitate storage on a nail or the like and for the attachment of a leveling string to assist in the building of the wall.

Any suitable advertising indicia 31 may be placed on the mortar stop, as shown.

The device is extremely low cost in terms of manufacturing and use and this cost is far exceeded by the savings in labor and material. Furthermore, its use contributes significantly to the construction of a sounder wall in a number of respects, as discussed previously.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A mortar stop for foundation walls constructed with hollow building blocks having vertical passages, said mortar stop comprising a thin mesh body portion of sufficient size to cover at least one passage of a building block, a comparatively small locator tab integrally attached to a medial portion of one end of the body portion and extending in the same plane of the body portion, said locator tab having a substantially narrower width than the width of said body portion and being of a length to project outwardly from one face of a wall having the mortar stop installed therein, and at least one weakened transverse separation line across the width of the locator tab and adapted for positioning substantially in the plane of the said one face of the wall whereby the locator tab can be easily chopped off by a mason's trowel.

2. A mortar stop for foundation walls as defined in claim 1, and said body portion being substantially rectangular.

3. A mortar stop for foundation walls as defined in claim 2, and said body portion having at least one transverse weakened separation line formed therein to facilitate removal of an end portion of the stop to size it for blocks of reduced width.

4. A mortar stop for foundation walls as defined in claim 1, and said tab having an aperture greater in size than the openings in the mesh body, and located adjacent the outward end thereof to facilitate attaching a leveling string to the tab.

5. A mortar stop for foundation walls as defined in claim 3, and said body portion having at least one longitudinal weakened separation line formed therein which intersects said transverse weakened separation line in said body portion at substantially right angles, to facilitate removal of a side portion of the stop to size it for block passages of reduced width.

* * * * *